United States Patent [19]

Antolini et al.

[11] Patent Number: 4,712,832

[45] Date of Patent: Dec. 15, 1987

[54] COVER, PARTICULARLY FOR VEHICLE SEATS

[76] Inventors: Adriano Antolini, Via Santucci, 58; Rodolfo Morigi, Via Fiume Abbandonato, 136; Giancarlo Saviotti, Via Savini, 31, all of 48100 Ravenna, Italy

[21] Appl. No.: 877,921

[22] Filed: Jun. 24, 1986

[30] Foreign Application Priority Data

Jun. 24, 1985 [IT] Italy ..... 3470 A/85
Jul. 8, 1985 [IT] Italy ..... 4950/85[U]

[51] Int. Cl.[4] ..... A47C 7/72

[52] U.S. Cl. ..... 297/180; 98/2.03; 5/461

[58] Field of Search ..... 297/180; 98/2.03; 5/461, 469

[56] References Cited

U.S. PATENT DOCUMENTS

| | | | |
|---|---|---|---|
| 1,475,912 | 11/1923 | Williams | 297/180 X |
| 1,514,329 | 11/1924 | Metcalf . | |
| 2,722,266 | 11/1955 | Kersten | 297/180 |
| 2,826,135 | 3/1958 | Benzick | 98/2 |
| 2,912,832 | 11/1959 | Clark | 62/172 |
| 2,992,604 | 7/1961 | Trotman | 98/2 |
| 3,101,660 | 8/1963 | Taylor | 98/2 |
| 3,137,523 | 6/1964 | Karner | 297/180 |
| 3,370,520 | 2/1968 | Mauch | 98/1 |
| 3,550,523 | 12/1970 | Segal | 98/2 |
| 3,738,702 | 6/1973 | Jacobs | 297/180 |
| 3,770,318 | 11/1973 | Fenton | 297/180 |
| 4,376,408 | 3/1983 | Iijima | 98/2.03 |
| 4,525,885 | 7/1985 | Hunt et al. | 5/469 X |

*Primary Examiner*—James T. McCall
*Attorney, Agent, or Firm*—Shlesinger Arkwright & Garvey

[57] ABSTRACT

A perfected cover, particularly for vehicle seats, characterized by the fact that it comprises a frame inside which are formed fluid ducts enabling fluid passage through a portion defining the aforementioned frame and therefore formed from material permeable by the aforementioned fluid.

12 Claims, 9 Drawing Figures

Fig. 8
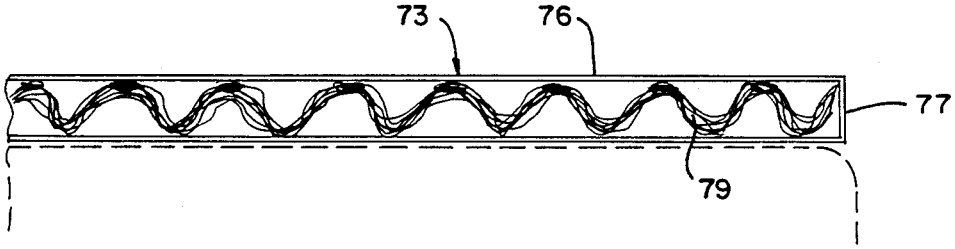
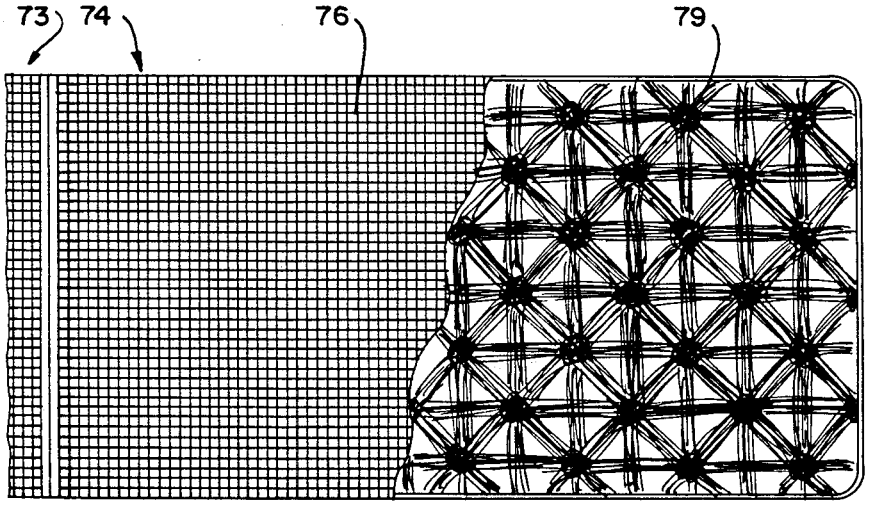
Fig. 9

COVER, PARTICULARLY FOR VEHICLE SEATS

The present invention relates to an improved seat cover, particularly, but not exclusively, for vehicle seats.

SUMMARY OF THE INVENTION

The aim of the present invention is to provide an improved cover, particularly for vehicle seats, enabling part of the user's body resting on the cover to be air conditioned.

With this aim in view, according to the present invention, there is provided an improved cover, particularly for vehicle seats, characterised by the fact that it comprises a frame having internal fluid ducts. The frame at least one portion formed from permeable material for enabling fluid pasage through the same.

BRIEF DESCRIPTION OF THE DRAWINGS

A number of preferred embodiments of the present invention will be described by way of examples with reference to the accompanying drawings in which:

FIG. 8 is a cross-sectional view of the cover of FIG. 7; and FIG. 9 is a fragmentary top view of the cover of FIG. 7.

DETAILED DESCRIPTION OF THE INVENTION

Figure 2:
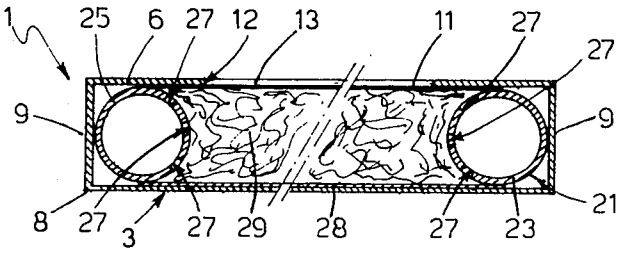
FIG. 2 is a fragmentary cross-sectional view of the holder case of FIG. 1.
Figure 5:
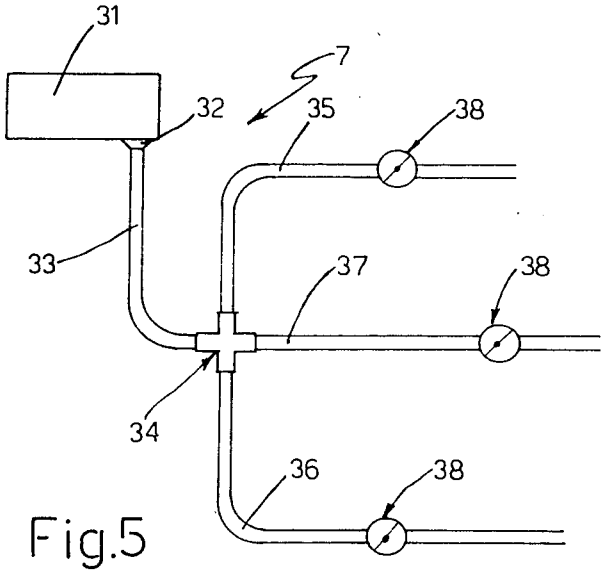
FIG. 5 is a schematic view of a system for supplying the covers of FIG. 1 or FIG. 4 with a given quantity of air.
Figure 1:
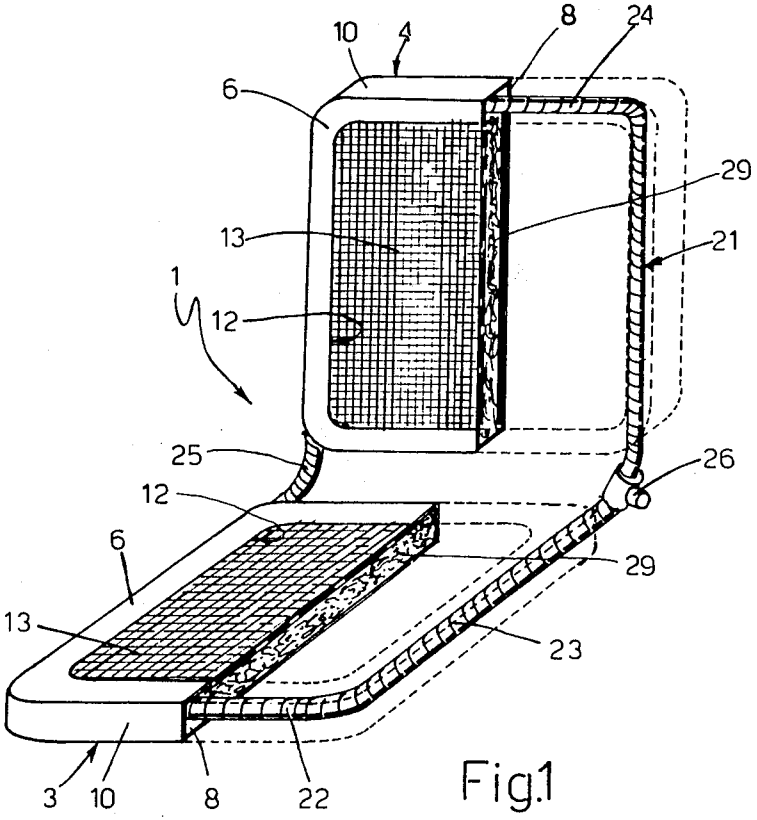
FIG. 1 is a perspective view with portions broken away of a first embodiment of the cover according to the present invention.
Figure 6:
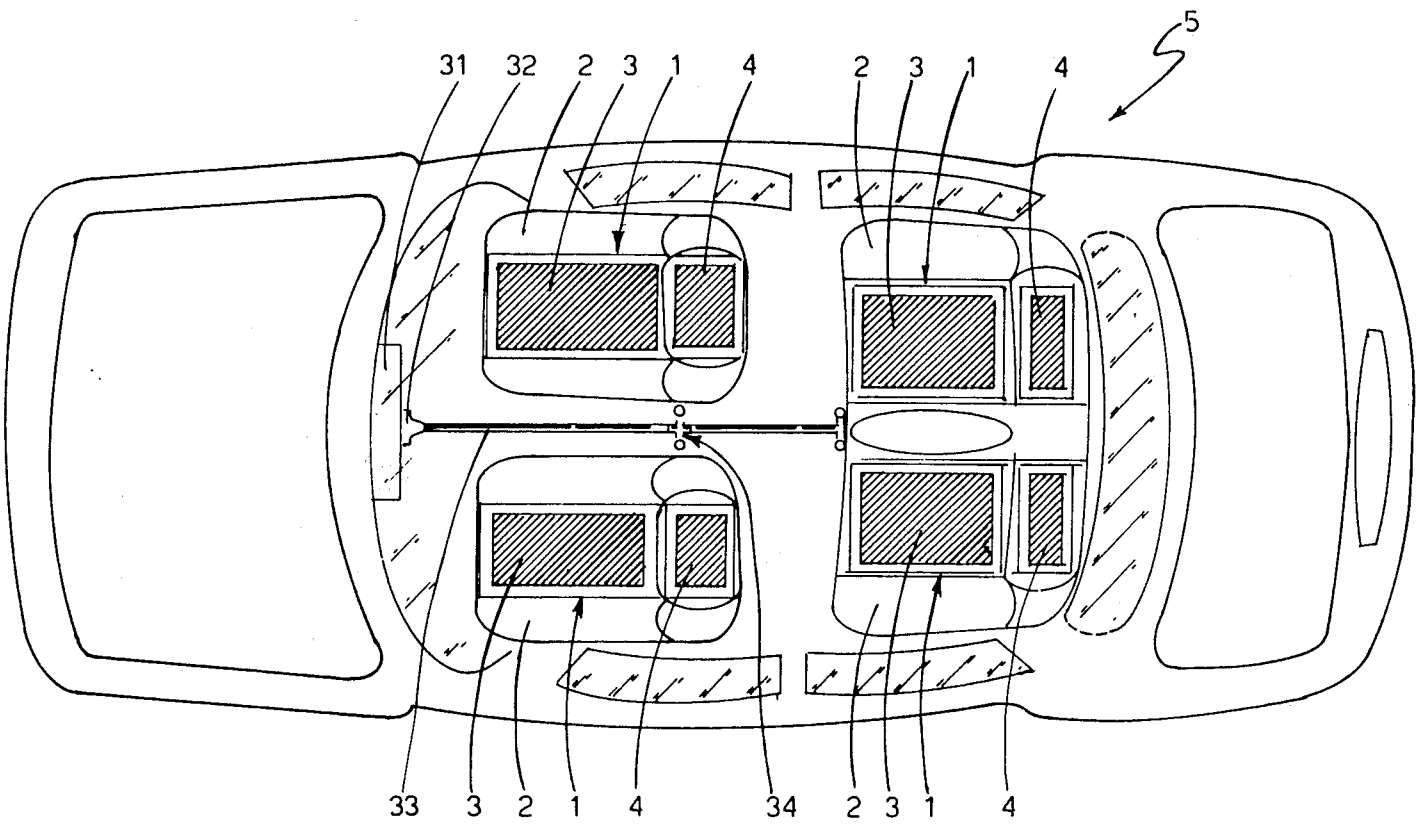
FIG. 6 is a schematic view of a vehicle fitted with the FIG. 5 system and the FIG. 1 covers.

Number 1 in FIGS. 1 and 2 indicates a cover designed to adapt to the seats 2 of the automobile 5 of FIG. 6. Cover 1 is connected to system 7 (FIG. 5) installed which is inside the automobile. The system 7 supplies the inside of cover 1 a given quantity of air. The air then flows outwardly through cover 1 towards the part of the user's body resting on cover 1. Cover 1 may constitute either the upholstery or an outer covering fitted over the upholstery of seat 2.

Cover 1 comprises two box-like cases 3 and 4. The cases 3 and 4 rest on the seat and backrest portions, respectively, of seat 2. Cases 3 and 4 are, preferably, formed from impermeable synthetic fabric and present a top wall 6, a bottom wall 8, two long side walls 9 and two short side walls 10. In top wall 6, there is formed a large rectangular through opening 12 designed to support a large part of the user's body. Opening 12 is covered with a layer 13 of permeable of synthetic or vegetable composition. Cover 1 also comprises a rectangular header 21, in turn, comprising a first portion 22 housed within case 3 next to side wall 10 and forming one end of cover 1. A second portion 23 has a first part housed within case 3 next to one of the side walls 9, and a second part housed within case 4 next to side wall 9 corresponding with the former. A third portion 24 is housed within case 4 next to the side wall 10 forming one end of cover 1. A fourth portion 25 including, in a similar manner to second portion 23, a first part housed within case 4 next to one of the side walls 9, and a second part housed within case 3 next to the side wall 9 corresponding with the former. From the connection portion between the two parts of second portion 23 of header 21, there extends outwardly a union 26 enabling fluid to be fed to header 21. Header 21 has a number of radial holes 27 distributed along its entire length. The inside surface of bottom walls 8 is fitted with a layer 28, preferably of polyvinyl chloride, whereas the inside surface of top walls 6 is fitted with a layer 11 of fabric for filtering and diffusing the air flow. Between layers 28 and 11, there is inserted a middle layer 29 having a honeycomb structure highly permeable by air, and preferably consists of a number of interwoven polyamide (nylon) yarns.

As shown in FIGS. 5 and 6, system 7 comprises an air distributor 31 which may consist of the existing fan normally forming part of the air conditioning circuit of the automobile 5. From air distributor 31, there extends a union 32 connected to a first end of duct 33, the second end of which is connected to a four-way distributor 34. From distributor 34, there extend two ducts 35 and 36 connected to the respective unions 26 of covers 1 of front seats 2, and a duct 37 connected to a three-way distributor (FIG. 6) from which extend a further two ducts relative to covers 1 of rear seats 2. Each of ducts 35, 36 and 37 is fitted with a throttle valve 38 for regulating air flow to the covers 1. In FIG. 5, the component parts of the air conditioning circuit of automobile 5 are shown schematically for the sake of simplicity.

Figure 3:
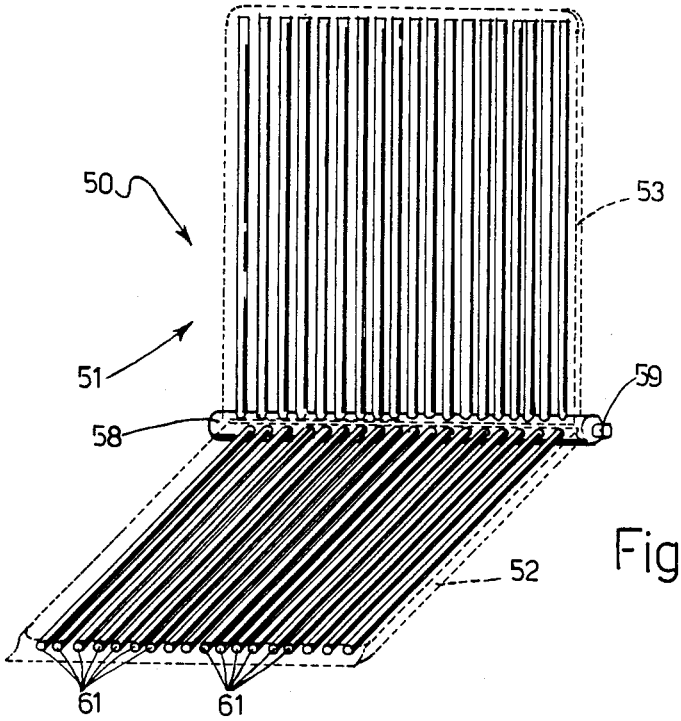
FIG. 3 is a perspective view of the fluid ducts of the cover of FIG. 1.
Figure 4:
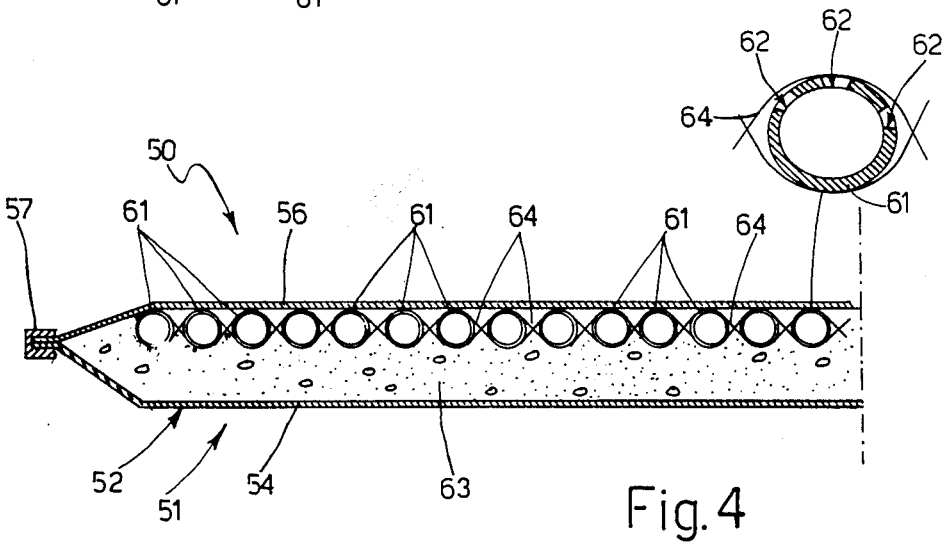
FIG. 4 is a fragmentary cross-sectional view of a second embodiment of the cover according to the present invention.

Number 50 in FIGS. 3 and 4 indicates a cover specially designed for the seats 2 of automobile 5. Cover 50 comprises a frame 51 having two box cases 52 and 53 designed to rest respectively on the seat and backrest portions of seat 2. Box cases 52 and 53 present a bottom wall 54 formed from impermeable synthetic fabric, and a top wall 56 formed from permeable fabric, preferably of synthetic or vegetable. The edges of walls 54 and 56 are stitched together, as shown in FIG. 4, and the resulting seam is fitted with trim 57 for preventing wear on the seam. Between cases 52 and 53, cover 50 comprises a header 58, preferably formed from polyvinyl chloride, and from one end of which there extends a union 59 for connection to the ducts 35, 36 and 37 of in FIG. 5. From header 58, there extends, inside both cases 52 and 53, a number of ducts 61, each having a number of radial holes 62 along their entire length. Ducts 61 within case 52 or 53 are arranged in parallel, are preferably formed from polyvinyl chloride, and are located beneath top wall 56. Between ducts 61 and bottom wall 54, cases 52 and 53 are fitted with an interior layer 63 of deformable soft material permeable by air, preferably foam rubber or sponge material. Ducts 61 in each case 52 and 53 are bound together by interwoven nylon yarns 64 as shown in FIG. 4.

Covers 1 and 50 differ as to both the type of air ducts installed inside, and the material and design of frame 3-4 and 51. Both covers 1 and 50 provide for connection to a compressed air source, and for conveying a given quantity of compressed air through respective top walls 6 and 56. In more detail, top walls 6 and 56 have permeable layers 11 and 56, respectively which the air is conveyed towards the part of the user's body resting on the layers 11 and 56, respectively.

Figure 7:
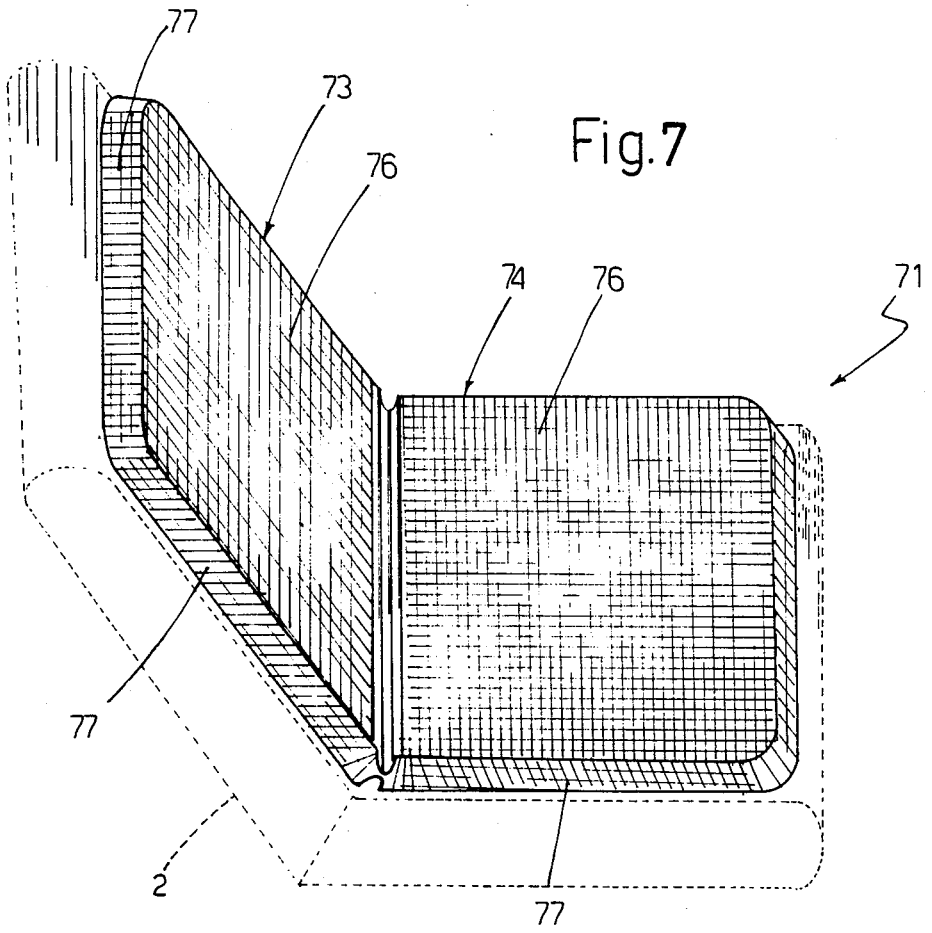
FIG. 7 is a perspective view of a third embodiment of the cover according to the present invention.

Number 71 in FIGS. 7 and 8 indicates a cover for a seat 2, shown by the dotted line in FIG. 7. The cover 71 comprises two box cases 73 and 74 designed to rest respectively on the backrest and seat portions of seat 2. Each box case 73 and 74 comprises a bottom wall 75, a top wall 76 and four side walls 77. In this embodiment, the two box cases 73 and 74 are connected together by two side walls 77 arranged in side by side relation and stitched together. Walls 75, 76 and 77 are formed from a material permeable by air, so as to enable air to circulate both outwardly and inwardly. Between bottom wall 75 and the top wall 76, there is inserted a layer 79 having a honeycomb structure and which consists of a number of interwoven polyamide (nylon) yarns. In use, the contact points between the said yarns and walls 75 and 76 are preferably welded together. Layer 79 thus constitutes an air duct to or from wall 76.

Cover 71 thus enables air to circulate therein, both outwardly and inwardly. As such, cover 71 may be connected to an air source via system 7 (FIG. 5), in which case, cover 71 must be fitted with a union for connecting the end portion with system 7. Cover 71 isolates the user's body from the top layer of seat 2 which layer generally consists of an impermeable material preventing air circulation.

The advantages of the present invention will be clear from the foregoing description.

In particular, covers 1, 50 and 71 may be adapted, not only to automobile seats, but also to armchairs, chairs and beds. Covers 1, 50 and 71 enable air to flow through the permeable part of the cover, in such a manner as to supply the part of the user's body resting on the cover with a quantity of air at a given temperatures, depending on the type of system upstream of covers 1, 50 and 71. Covers 1, 50 and 71 may also be installed in beds for effectively relieving the discomfort and bedridden patients.

To those skilled in the art it will be clear that changes may be made to covers 1, 50 and 71 as described herein without, however, departing from the scope of the present invention.

As already stated, covers 1, 50 and 71 may constitute either the upholstery or an outer covering placed over the upholstery of seat 2. Furthermore, covers 1, 50 and 71 may be formed in one piece using a deformable material adaptable to any type of seat. The type of fluid ducts may also be other than as described herein. Finally, system 7 may be replaced by a system for extracting air from the cover and, therefore, extracting from the same the heat produced by the user's body.

We claim:

1. A cover for seats used in vehicles or the like for channelling air at a desired temperature to an occupant's body, comprising:

(a) a first outer layer for being positioned adjacent the body of an occupant of the vehicle;

(b) a first inner layer extending substantially parallel to said outer layer;

(c) a first intermediate layer positioned between said first outer layer and said first inner layer;

(d) said intermediate layer including a plurality of interwoven members welded together and forming a substantially honeycomb-shaped structure permitting free circulation of air therethrough and sturdy support for the occupant's body;

(e) said intermediate layer including upper and lower substantially planar surfaces;

(f) means for securing said substantially planar upper surface to said outer layer; and (g) means for securing said substantially planar lower surface to said inner layer.

2. A cover as in claim 1, wherein:

(a) said plurality of interwoven members are polyamide yarns.

3. A cover as in claim 1, wherein:

(a) said inner layer is formed from an impermeable material.

4. A cover as in claim 1, wherein:

(a) said inner layer is formed from a permeable material.

5. A cover as in claim 1, wherein:

(a) said cover is integral with the seat for forming at least a portion of the upholstery thereof.

6. A cover as in claim 1, wherein:

(a) said cover is associated with the seat such that the first inner layer rests on the upholstery of the seat thereby enabling the cover to be readily removed therefrom.

7. A cover for seats used in vehicles or the like for channelling air at a desired temperature to an occupant's body, comprising:

(a) at least a first case;

(b) said first case including a first outer layer, a first inner layer, and a first intermediate layer;

(c) said first outer layer being positioned adjacent to the body of the occupant;

(d) said first intermediate layer extending substantially parallel to said outer layer;

(e) said intermediate layer positioned between said first outer layer and said first inner layer;

(f) said intermediate layer including a plurality of interwoven members welded together having substantially honeycomb-shaped structure permitting free circulation of air therethrough and sturdy support for the occupant's body;

(g) said intermediate layer including upper and lower substantially planar surfaces;

(h) means for securing and substantially planar upper surface to said first outer layer; and (i) means for securing said substantially lower planar surface to said first inner layer.

8. A cover as in claim 7, wherein:

(a) said cover includes a second case; and (b) means for securing said first case to said second case.

9. A cover as in claim 8, wherein:

(a) said second case includes a second inner layer, a second outer layer, and a second intermediate layer; and (b) said second intermediate layer being positioned between said second inner layer and said second outer layer.

10. A cover as in claim 9, wherein:

(a) said second intermediate layer includes a plurality of interwoven members welded together forming a substantially honeycomb-shaped structure permitting free circulation of air therethrough and sturdy support for the occupant's body.

11. A cover as in claim 8, wherein:

(a) said first case is positioned adjacent the backrest element of the seat and said second case member is positioned adjacent the seat rest element of the seat.

12. A cover as in claim 9, wherein:

(a) said second outer layer is positioned adjacent to the occupant's body.

* * * * *